US011439205B2

(12) United States Patent
Lu

(10) Patent No.: US 11,439,205 B2
(45) Date of Patent: Sep. 13, 2022

(54) SHOE LAST FOR AIR ACTIVATION AND AIR COOLING

(71) Applicant: TRUE TEN INDUSTRIAL CO., LTD., Taichung (TW)

(72) Inventor: Shun-Tsung Lu, Taichung (TW)

(73) Assignee: TRUE TEN INDUSTRIAL CO., LTD., Taichung (TW)

( * ) Notice: Subject to any disclaimer, the term of this patent is extended or adjusted under 35 U.S.C. 154(b) by 39 days.

(21) Appl. No.: 17/105,850

(22) Filed: Nov. 27, 2020

(65) Prior Publication Data

US 2022/0167713 A1 Jun. 2, 2022

(51) Int. Cl.
*A43D 3/04* (2006.01)
*A43D 3/02* (2006.01)

(52) U.S. Cl.
CPC ..... *A43D 3/04* (2013.01); *A43D 3/02* (2013.01)

(58) Field of Classification Search
CPC ..... A43D 3/02; A43D 3/1408; A43D 3/1491; A47L 23/20; A47L 23/205
See application file for complete search history.

(56) References Cited

U.S. PATENT DOCUMENTS 881,338 A * 3/1908 Post ..... A43D 3/1475 34/103
3,793,744 A * 2/1974 Saita ..... A43D 3/1491 34/104
4,266,750 A * 5/1981 Gallizia ..... B29D 35/0018 249/185

FOREIGN PATENT DOCUMENTS

GB 2575501 A * 1/2020 ..... A43D 3/02

* cited by examiner

*Primary Examiner* — Ted Kavanaugh
(74) *Attorney, Agent, or Firm* — Rabin & Berdo, P.C.

(57) ABSTRACT

A shoe last for air activation and air cooling utilized to heat and activate as well as cool and shape a semi-finished shoe made up of a midsole and a vamp includes a body, at least one inlet, and at least one jet outlet. The body has an outer surface. The at least one inlet is disposed on the outer surface of the body. The at least one jet outlet is disposed on the outer surface of the body, is spaced apart from the at least one inlet, and fluidly communicates with the at least one inlet. The semi-finished shoe is sleeved on the body and covers the at least one jet outlet. Gas is injected into the body via the at least one inlet, flows out of the body via the at least one jet outlet, and is ejected to the semi-finished shoe.

9 Claims, 7 Drawing Sheets

SHOE LAST FOR AIR ACTIVATION AND AIR COOLING

BACKGROUND OF THE INVENTION

1. Field of the Invention

The present invention relates to a shoe last, and more particularly to a shoe last for air activation and air cooling.

2. Description of Related Art

To process a vamp of a shoe, the vamp should be placed in a conventional activation machine to be heated and activated firstly. After the vamp is activated, the vamp should be placed in a conventional shaping machine to be cooled and shaped. In the manufacture of the vamp, the vamp has to be placed in two different machines including the conventional activation machine and the conventional shaping machine, which lowers the efficiency of the manufacture of the vamp. Moreover, the conventional activation machine and the conventional shaping machine are both expensive, and the cost of the manufacture of the vamp is raised thereby.

To overcome the shortcomings of the conventional activation machine and the conventional shaping machine, the present invention tends to provide a shoe last for air activation and air cooling to mitigate or obviate the aforementioned problems.

SUMMARY OF THE INVENTION

The main objective of the present invention is to provide a shoe last for air activation and air cooling.

The shoe last for air activation and air cooling is utilized to heat and activate as well as cool and shape a semi-finished shoe made up of a midsole and a vamp. The shoe last for air activation and air cooling includes a body, at least one inlet, and at least one jet outlet. The body has an outer surface. The at least one inlet is disposed on the outer surface of the body. The at least one jet outlet is disposed on the outer surface of the body, is spaced apart from the at least one inlet, and fluidly communicates with the at least one inlet. The semi-finished shoe is sleeved on the body and covers the at least one jet outlet. Gas is injected into the body via the at least one inlet, flows out of the body via the at least one jet outlet, and is ejected to the semi-finished shoe.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
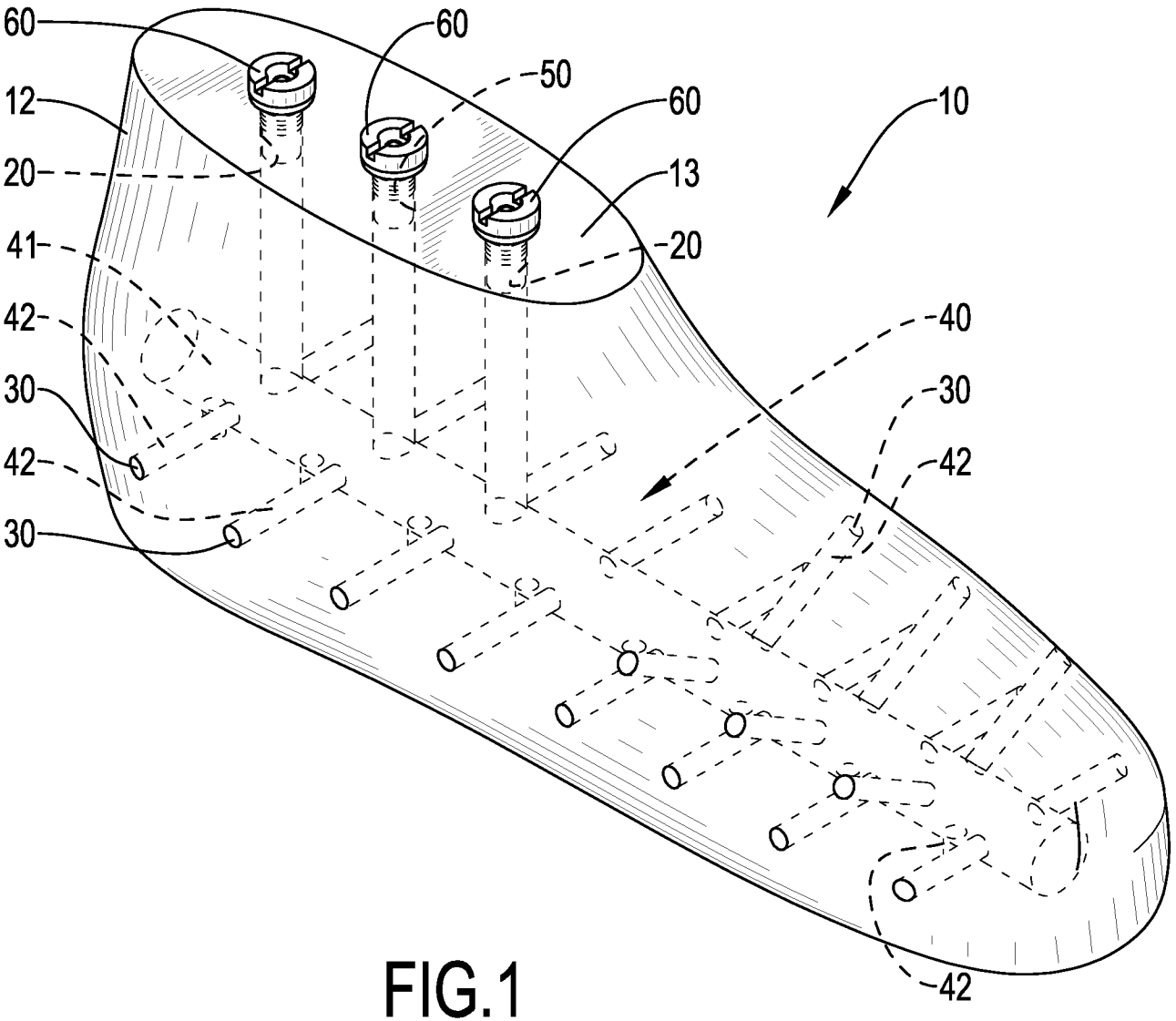
FIG. 1 is a perspective view of a shoe last for air activation and air cooling in accordance with the present invention.
Figure 2:
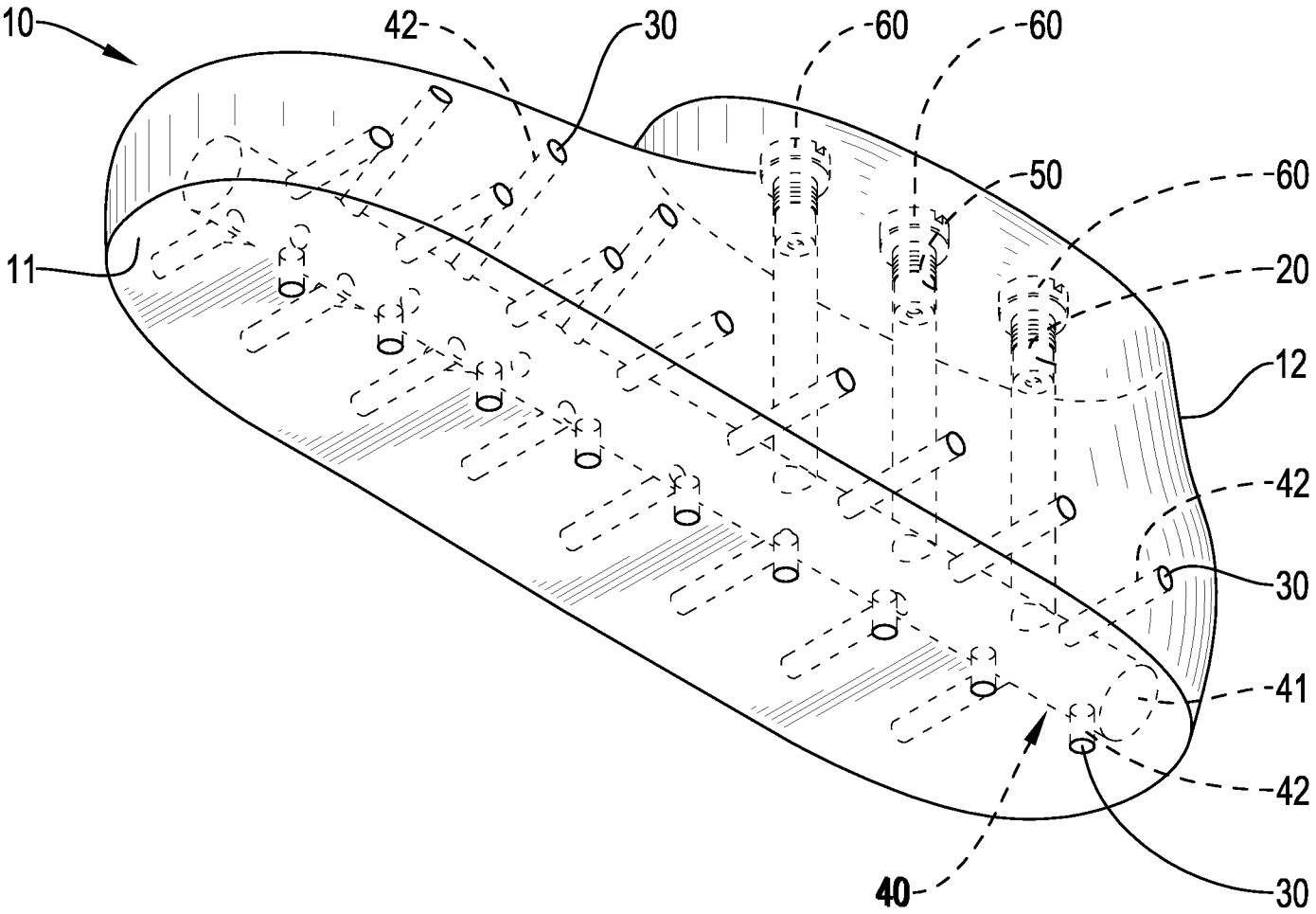
FIG. 2 is another perspective view of the shoe last for air activation and air cooling in FIG. 1.
Figure 4:
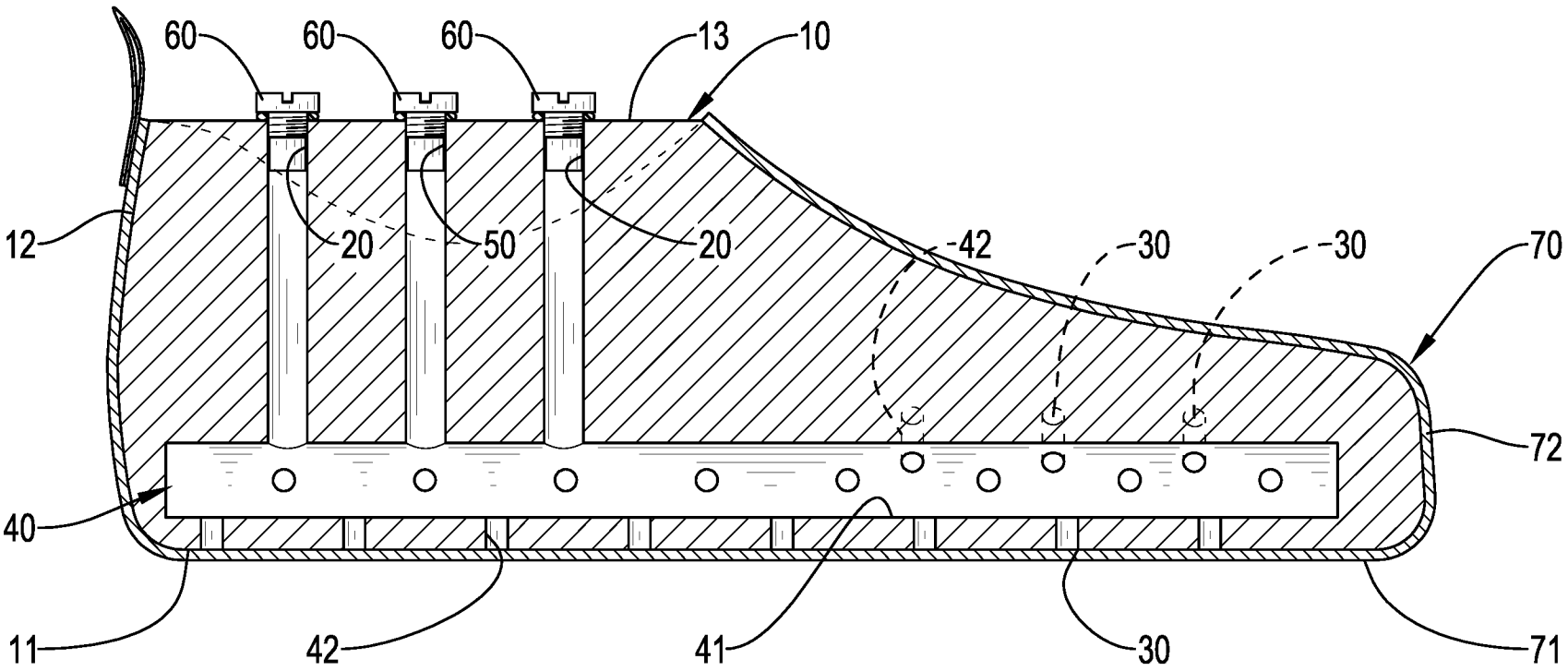
FIG. 4 is an operational side view in partial section of the shoe last for air activation and air cooling in FIG. 1.

With reference to FIGS. 1, 2, and 4, a shoe last for air activation and air cooling in accordance with the present invention is utilized to heat and activate as well as cool and shape a semi-finished shoe 70 made up of a midsole 71 and a vamp 72, and the shoe last for air activation and air cooling includes a body 10, at least one inlet 20, at least one jet outlet 30, a gas channel 40, a blowing inlet 50, and multiple gas nozzles 60.

Figure 3:
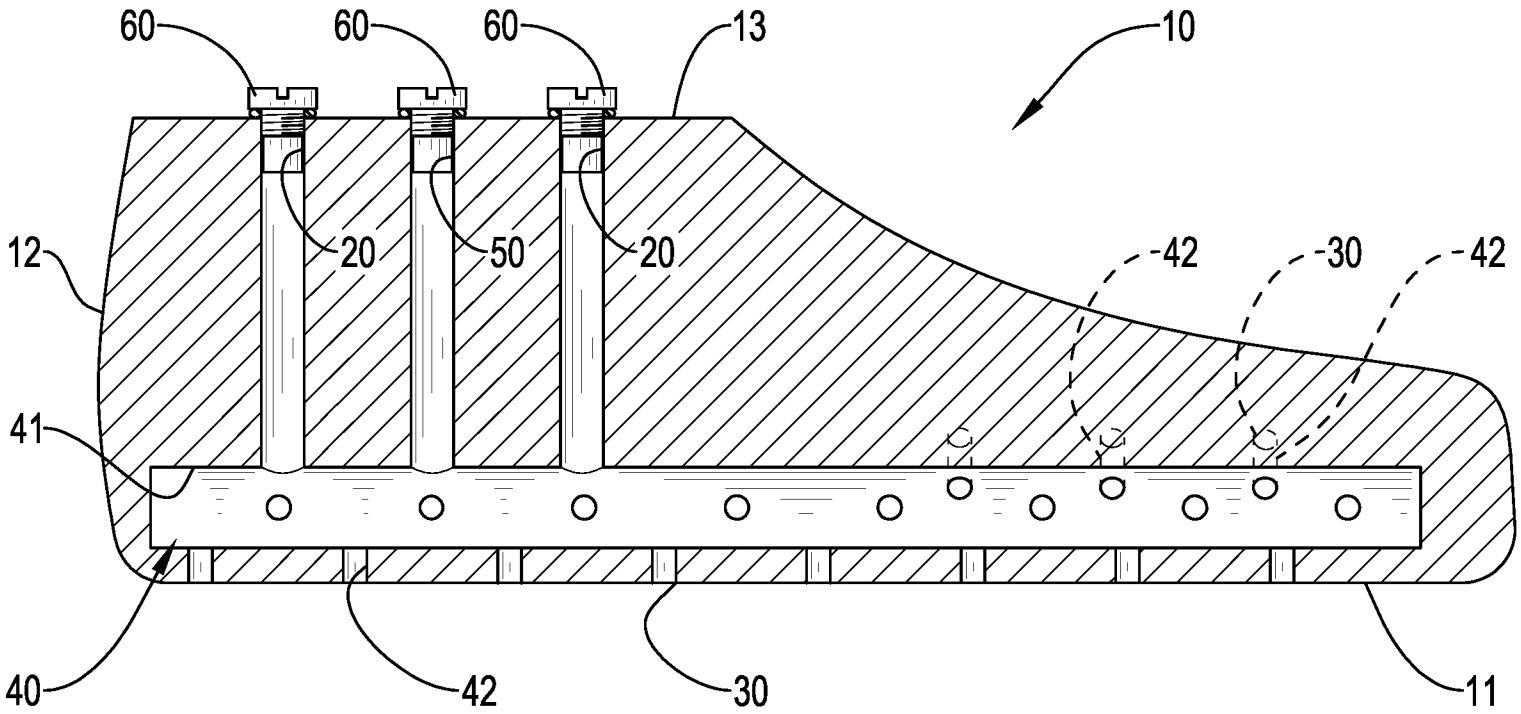
FIG. 3 is a side view in partial section of the shoe last for air activation and air cooling in FIG. 1.

With reference to FIGS. 1 to 3, the body 10 has an outer surface, and the outer surface of the body 10 includes a bottom surface 11, a side surface 12, and a top surface 13. The side surface 12 has a bottom circumference and an upper circumference respectively connected to the bottom surface 11 and the top surface 13. The bottom surface 11 and the top surface 13 are spaced apart from each other. With reference to FIG. 4, when the semi-finished shoe 70 is sleeved on the body 10, the bottom surface 11 of the body 10 abuts against the midsole 71 of the semi-finished shoe 70, and the side surface 12 of the body 10 abuts against the vamp 72 of the semi-finished shoe 70.

With reference to FIGS. 1 to 3, the at least one inlet 20 is disposed on the outer surface of the body 10. In the present invention, the shoe last for air activation and air cooling in accordance with the present invention includes two said inlets 20. The two said inlets 20 are disposed on the top surface 13 of the body 10, and one of the two said inlets 20 is adjacent to a front end of the body 10, and the other one of the two said inlets 20 is adjacent to a rear end of the body 10.

With reference to FIGS. 1 to 3, the at least one jet outlet 30 is disposed on the outer surface of the body 10. Furthermore, the at least one jet outlet 30 is disposed on the side surface 12 of the body 10, is spaced apart from the at least one inlet 20, and fluidly communicates with the at least one inlet 20. With reference to FIG. 4, the vamp 72 of the semi-finished shoe 70 covers the at least one jet outlet 30. In the present invention, the shoe last for air activation and air cooling in accordance with the present invention includes multiple said jet outlets 30. Several ones of the multiple said jet outlets 30 are disposed on the side surface 12 of the body 10 at spaced intervals. The rest of the multiple said jet outlets 30 are disposed on the bottom surface 11 of the body 10 at spaced intervals, and the rest of the multiple said jet outlets 30 are covered by the midsole 71 of the semi-finished shoe 70. Each one of the multiple said jet outlets 30 fluidly communicates with the two said inlets 20.

With reference to FIGS. 1 to 4, the gas channel 40 is formed in the body 10, and the gas channel 40 fluidly communicates with the at least one inlet 20 and the at least one jet outlet 30, such that gas is injected into the gas channel 40 via the at least one inlet 20, flows out of the body 10 via the at least one jet outlet 30, and is ejected to the vamp 72 of the semi-finished shoe 70. The gas channel 40 has a main section 41 and at least one jet section 42. The main section 41 fluidly communicates with the at least one inlet 20. One of two ends of the at least one jet section 42 fluidly communicates with the main section 41, and the other one of the two ends of the at least one jet section 42 fluidly communicates with the at least one jet outlet 30. An inner diameter of the at least one jet section 42 is smaller than that of the main section 41.

Furthermore, the gas channel 40 has multiple said jet sections 42, and one of the two ends of each one of the multiple said jet sections 42 away from the main section 41 fluidly communicates with a respective one of the multiple said jet outlets 30. The gas flows out of the body 10 via the multiple said jet outlets 30 after flowing into the main section 41 and is ejected to the semi-finished shoe 70 by diffusion. In such a way, the midsole 71 and the vamp 72 of the semi-finished shoe 70 can be heated and activate as well as cooled and shaped evenly. With such a structure, the circumstance that the pressure of the gas decreases while flowing from the main section 41 to each one of the multiple said jet sections 42 is prevented, so the effect of the gas ejection to the midsole 71 and the vamp 72 of the semi-finished shoe 70 of the present invention is ensured.

Figure 5:
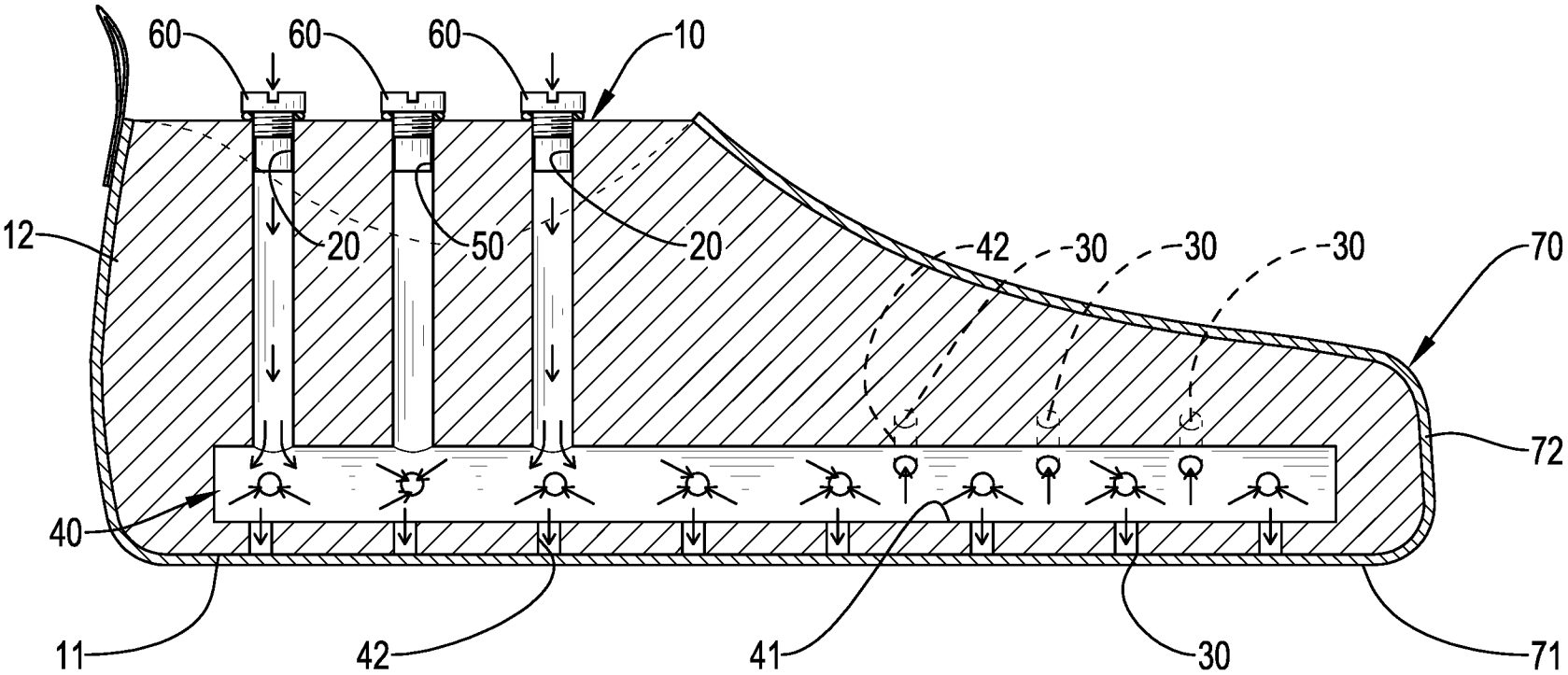
FIG. 5 is another operational side view in partial section of the shoe last for air activation and air cooling in FIG. 1.

With reference to FIGS. 1 to 3, the blowing inlet 50 is disposed on the top surface 13 of the outer surface of the body 10, is spaced apart from the at least one inlet 20 and the at least one jet outlet 30, and fluidly communicates with the main section 41 of the gas channel 40. With reference to FIG. 5, after the gas is injected into the main section 41 via the blowing inlet 50, the gas flows out of the body 10 via the multiple said jet sections 42 and is ejected to the semi-finished shoe 70 to flare the semi-finished shoe 70. In this way, the semi-finished shoe 70 and the body 10 can be separated.

With reference to FIGS. 1 to 3, in the present invention, two of the multiple gas nozzles 60 are mounted to the two said inlets 20, and the other one of the multiple gas nozzles 60 is mounted to the blowing inlet 50.

With reference to FIG. 4, to use the shoe last for air activation and air cooling in accordance with the present invention to heat and activate the semi-finished shoe 70 and cool and shape the semi-finished shoe 70, sleeve the semi-finished shoe 70 on the body 10 firstly. With reference to FIG. 5, next, inject heated gas into the gas nozzle 60 mounted to the at least one inlet 20, such that the heated gas can be injected into the main section 41 of the gas channel 40 via the at least one inlet 20 and in turn diffuses into the multiple said jet sections 42. Finally, the heated gas flows out of the body 10 via the multiple said jet outlets 30 and is ejected to the midsole 71 and the vamp 72 of the semi-finished shoe 70 to heat and activate the midsole 71 and the vamp 72. After the semi-finished shoe 70 is heated and activated, inject cooled gas into the gas nozzle 60 mounted to the at least one inlet 20, such that the cooled gas can be injected into the main section 41 of the gas channel 40 via the at least one inlet 20 and in turn diffuses into the multiple said jet sections 42. Finally, the cooled gas flows out of the body 10 via the multiple said jet outlets 30 and is ejected to the midsole 71 and the vamp 72 of the semi-finished shoe 70 to cool and shape the midsole 71 and the vamp 72.

Figure 6:
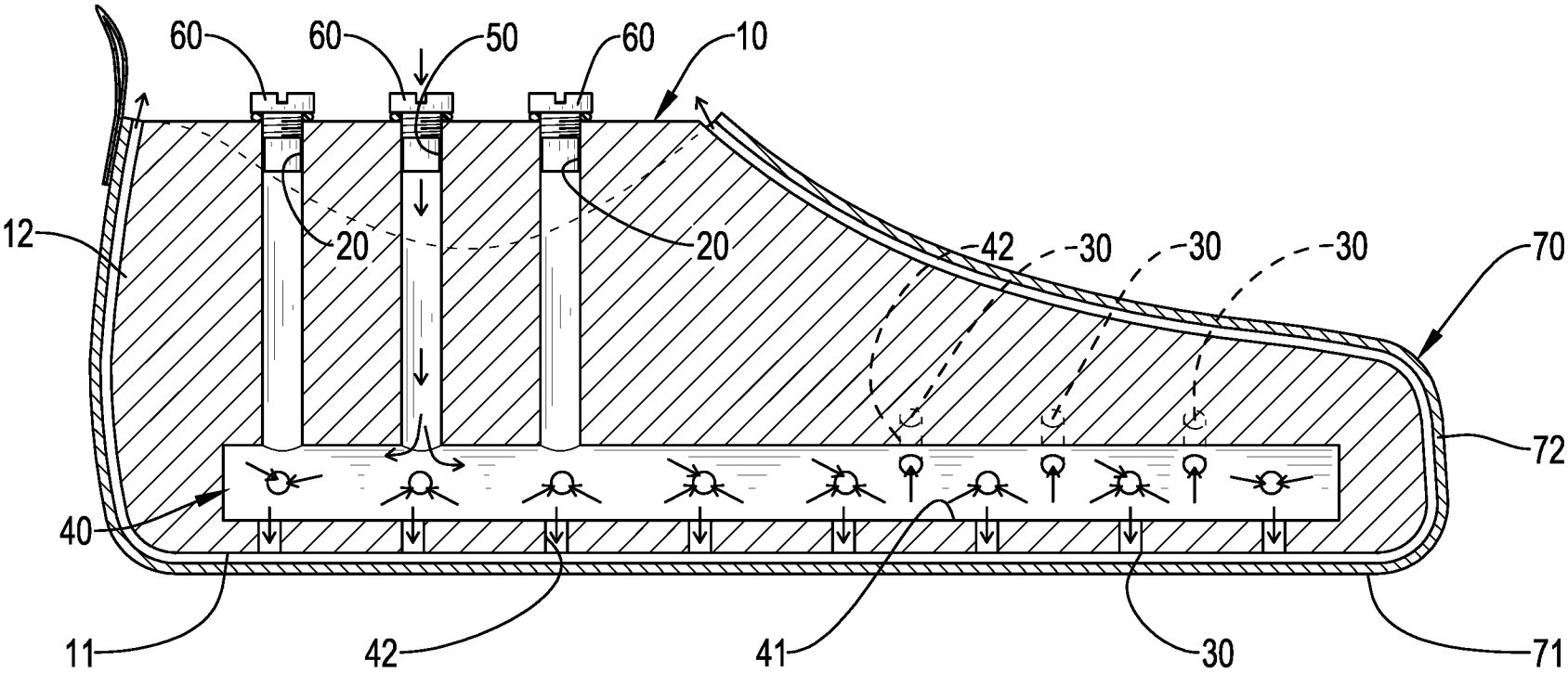
FIG. 6 is still another operational side view in partial section of the shoe last for air activation and air cooling in FIG. 1.

With reference to FIG. 6, after the midsole 71 and the vamp 72 are cooled and shaped, inject the gas into the gas nozzle 60 mounted to the blowing inlet 50. The gas flows through the main section 41 of the gas channel 40, diffuses into the multiple said jet sections 42, and flows out of the body 10 via the multiple said jet outlets 30 to eject to the semi-finished shoe 70 to flare the semi-finished shoe 70. Then, the semi-finished shoe 70 and the body 10 are separated, and a user can detach the processed semi-finished shoe 70 from the body 10 easily. Finally, the user can bond an outsole 80 to the midsole 71 of the semi-finished shoe 70 to make a shoe.

Figure 7:
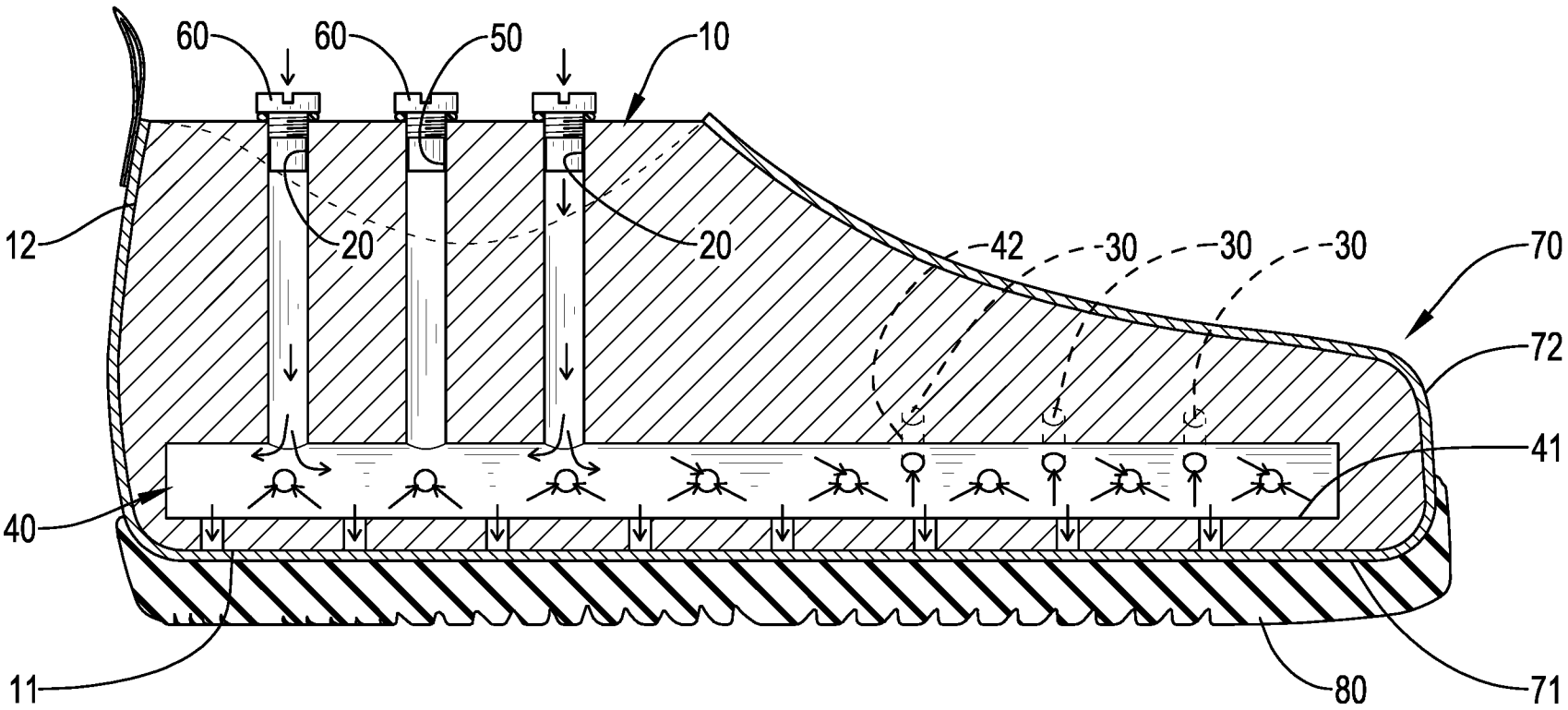
FIG. 7 is further another operational side view in partial section of the shoe last for air activation and air cooling in FIG. 1.

With reference to FIG. 7, to enhance the efficiency of the manufacture of the shoe, the user can bond the midsole 71 of the semi-finished shoe 70 to the outsole 80 with colloid smeared thereon after the semi-finished shoe 70 is sleeved on the body 10. Then the user can inject heated gas into the body 10 to make the heated gas flow out of the multiple said jet outlets 30 to heat and activate the midsole 71 and the vamp 72 of the semi-finished shoe 70. Since thermal energy can be transferred from the midsole 71 to the outsole 80 by heat conduction, the colloid smeared on the outsole 80 can also be activated while the midsole 71 and the vamp 72 are being activated. In this way, the outsole 80 can be bonded to the midsole 71 of the semi-finished shoe 70. Next, inject cooled gas into the body 10 to make the cooled gas flow out of the multiple said jet outlets 30 to cool and shape the midsole 71 and the vamp 72 of the semi-finished shoe 70. Also, the colloid smeared on the outsole 80 can be cooled and coagulated simultaneously.

With the aforementioned technical characteristics, the shoe last for air activation and air cooling in accordance with the present invention has the following advantages.

1. By having the at least one inlet 20 and the at least one jet outlet 30 disposed on the outer surface of the body 10 and having the gas channel 40 fluidly communicating the at least one inlet 20 and the at least one jet outlet 30, the gas sequentially flows through the at least one inlet 20, the gas channel 40 and the at least one jet outlet 30 and is ejected to the semi-finished shoe 70. Thus, the shoe last for air activation and air cooling in accordance with the present invention can be utilized to heat and activate as well as cool and shape the midsole 71 and the vamp 72 of the semi-finished shoe 70 by adjusting the temperature of the gas. Compared with the manufacture of the vamp utilizing the conventional activation machine and the conventional shaping machine, the midsole 71 and the vamp 72 can be heated and activated and cooled and shaped without moving the semi-finished shoe 70, which enhances the efficiency of the manufacture of the semi-finished shoe 70.

2. The conventional shaping machine and the conventional activation machine can only process the vamp. On the contrary, since the present invention is a last, the shoe last for air activation and air cooling in accordance with the present invention can process the midsole 71 and the vamp 72 at the same time.

3. To enhance the efficiency of the manufacture of the shoe, the user can bond the midsole 71 of the semi-finished shoe 70 to the outsole 80 with colloid smeared thereon. In such a manner, the colloid smeared on the outsole 80 can be activated or cooled while the midsole 71 and the vamp 72 are being activated or shaped. Therefore, the user does not have to bond the outsole 80 to the semi-finished shoe 70 after the semi-finished shoe 70 is cooled and shaped.

4. The structure of the shoe last for air activation and air cooling in accordance with the present invention is simple, so the cost of the shoe last for air activation and air cooling in accordance with the present invention is low compared with the conventional activation machine and the conventional shaping machine, which lowers the cost of the manufacture of the semi-finished shoe 70.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A shoe last for air activation and air cooling utilized to heat and activate and cool and shape a semi-finished shoe, the shoe last comprising:

a body being a single component and having an outer surface, a front end, and a rear end;

two inlets disposed on the outer surface of the body, one of the two inlets being adjacent to the front end of the body, and the other one of the two inlets being adjacent to the rear end of the body;

at least one jet outlet disposed on the outer surface of the body, spaced apart from the two inlets, and fluidly communicating with the two inlets;

a gas channel formed in the body, fluidly communicating with the two inlets and the at least one jet outlet, and having a main section fluidly communicating with the two inlets, the main section being directly formed in the body and extending toward the front end and the rear end of the body, and at least one jet section having two ends, one of the two ends of the at least one jet section fluidly communicating with the main section, and the other one of the two ends of the at least one jet section fluidly communicating with the at least one jet outlet; and a blowing inlet disposed on the outer surface of the body, spaced apart from the two inlets and the at least one jet outlet, and fluidly communicating with the main section of the gas channel and directly extending to the main section, wherein the shoe last is so formed that the semi-finished shoe is sleevable on the body to cover the at least one jet outlet, such that gas is injectable into the body via the two inlets, and is injectable into the main section via the blowing inlet, to flow out of the body via the at least one jet section and the at least one jet outlet, to thereby be injectable to the semi-finished shoe to flare the semi-finished shoe, so that the semi-finished shoe and the body are separated from each other.

2. The shoe last for air activation and air cooling as claimed in claim 1, wherein an inner diameter of the at least one jet section is smaller than an inner diameter of the main section.

3. The shoe last for air activation and air cooling as claimed in claim 2, wherein the shoe last for air activation and air cooling has at least three jet outlets disposed on the outer surface of the body at spaced intervals; and the gas channel has at least three jet sections, and one of the two ends of each one of the at least three jet outlets away from the main section fluidly communicates with a respective one of the at least three jet outlets;

wherein the gas flows out of the body via the at least three jet outlets and is ejected to the semi-finished shoe by diffusion.

4. The shoe last for air activation and air cooling as claimed in claim 1, wherein the outer surface of the body has a bottom surface, a side surface, and a top surface;

the shoe last for air activation and air cooling has at least two jet outlets, one of the at least two jet outlets disposed on the bottom surface of the outer surface of the body, the rest of the at least two jet outlets disposed on the side surface of the outer surface of the body.

5. The shoe last for air activation and air cooling as claimed in claim 4, wherein the gas channel has at least two jet sections, and each one of the at least two jet sections having two ends, one of the two ends of each one of the at least two jet sections fluidly communicating with the main section, and the other one of the two ends of each one of the at least two jet sections fluidly communicating with a respective one of the at least two jet outlets.

6. The shoe last for air activation and air cooling as claimed in claim 5, wherein the at least one inlet and the blowing inlet are both disposed on the top surface of the outer surface of the body.

7. The shoe last for air activation and air cooling as claimed in claim 5, wherein an inner diameter of each one of the at least two jet sections is smaller than an inner diameter of the main section.

8. The shoe last for air activation and air cooling as claimed in claim 1, wherein the shoe last for air activation and air cooling has at least three jet outlets, the at least three jet outlets disposed on the outer surface of the body at spaced intervals; and the gas channel has at least three jet sections, and one of the two ends of each one of the at least three jet outlets away from the main section fluidly communicating with a respective one of the at least three jet outlets;

wherein the gas flows out of the body via the at least three jet outlets and is ejected to the semi-finished shoe by diffusion.

9. The shoe last for air activation and air cooling as claimed in claim 1, wherein the outer surface of the body has a bottom surface, a side surface, and a top surface; and the at least one inlet and the blowing inlet are both disposed on the top surface of the outer surface of the body.

* * * * *